United States Patent [19]

Roche et al.

[11] Patent Number: 4,756,123

[45] Date of Patent: Jul. 12, 1988

[54] CHAMBER DOOR

[75] Inventors: John N. Roche, Greenville; David Zolner, Fairview, both of Pa.

[73] Assignee: American Sterilizer Company, Erie, Pa.

[21] Appl. No.: 934,587

[22] Filed: Nov. 25, 1986

[51] Int. Cl.[4] ..... E05F 7/02

[52] U.S. Cl. ..... 49/255; 16/243

[58] Field of Search ..... 49/255, 256, 254; 16/243, 248, 249, 351

[56] References Cited

U.S. PATENT DOCUMENTS 1,202,068 10/1916 Juruick ..... 49/256

3,631,629 1/1972 Bercheux ..... 49/256

FOREIGN PATENT DOCUMENTS 2329263 12/1974 Fed. Rep. of Germany ..... 49/255

*Primary Examiner*—Philip C. Kannan

*Attorney, Agent, or Firm*—Kirkpatrick & Lockhart

[57] ABSTRACT

A door which may undergo rotational as well as vertical and horizontal movement relative to a door frame is provided. The door is provided with a lifting means which includes a slide plate which may be vertically displaced relative to the door. A lever is pivotally mounted on the door with one end having a roller which engages a slot on the slide plate and the other end having a roller which engages a block mounted on the door frame. The vertical displacement of the slide plate causes the lever's roller to ride in the slot until the roller reaches the end of the slot at which point the slide plate causes the lever to lift the door relative to the door frame. To accommodate such door movement, the door is provided with a hinge which includes a clevis mounted on the door frame which includes a lower section having a bearing surface and an upper section having an internal cavity. The internal cavity includes an internal shoulder area and slots which communicate with the lower area of the upper clevis section. A hinge member is affixed to the door and includes a body having an upwardly extending portion of a diameter less than that of the internal cavity of the upper clevis section. The upper section of the hinge member includes radially extending lugs which may engage the internal shoulder of the cavity. As such, in the upper position the lugs ride on the internal shoulder while in the lower position the bottom of the hinge member rides on the bearing surface of the lower clevis section.

18 Claims, 4 Drawing Sheets

Fig. 8A.
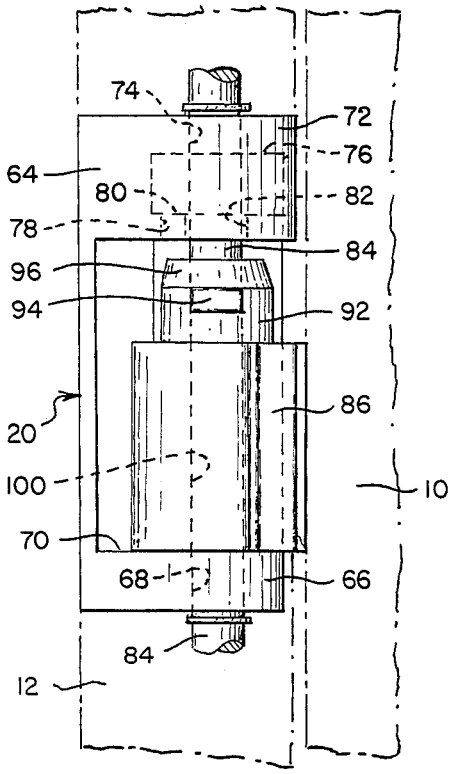
Fig. 8B.
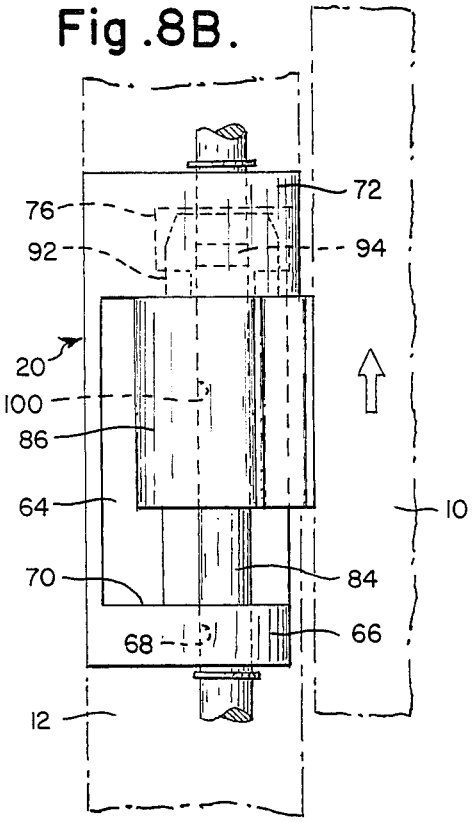
Fig. 9A.
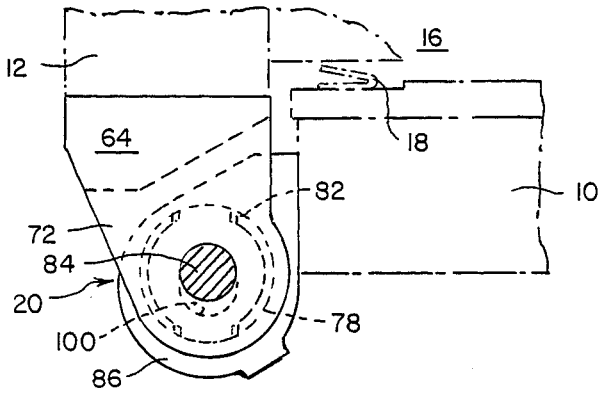
Fig. 9C.
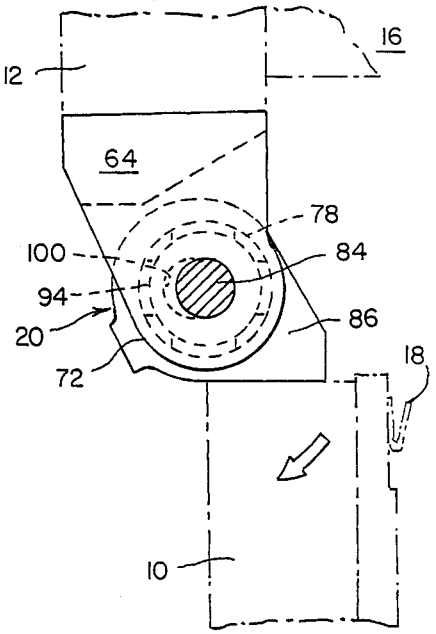
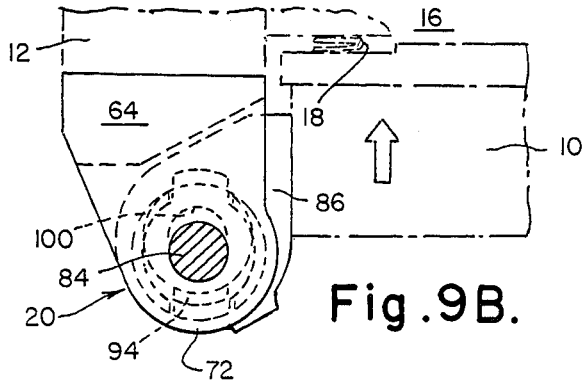
Fig. 9B.

CHAMBER DOOR

BACKGROUND OF THE INVENTION

1. Field of the Invention

The present invention relates to closures for chambers and, in particular, to a chamber door which may be vertically displaced relative to the door frame as well as undergo rotational movement.

2. Description of the Invention Background

Various forms of door-like closures for openings in and surrounded by a frame are known. In many types of doors, the door is mounted for rotational or swinging movement relative to a door frame by means of a hinge. Most often, the door is only configured to rotate or swing relative to a door frame and no other door movements are possible.

However, in some instances, it is expedient that a door be capable of movements in addition to swinging relative to the door frame. For example, in certain environments, a door of a pressurizable chamber, such as a sterilization apparatus, must be movable between an open position in which access to the chamber is permitted, an intermediate position in which access to the chamber is prohibited but in which the door is not in complete alignment with the door frame of the chamber, a confronting position in which the door is vertically lowered relative to the door frame so that the door is in facing relation thereto and a sealed position in which the door is moved horizontally toward the door frame to effect the sealing of the chamber by the door's seal. In such an apparatus, the door must be capable of rotational movement between the open and the intermediate positions, vertical displacement between the intermediate and confronting positions and horizontal displacement between the confronting and sealed positions. Previous means for vertically displacing a door have proven problematic. For example, in some systems, the door is manually lifted by an operator. While this approach may be suitable for small, wall-mounted chambers, it will be readily appreciated that such a structure is completely unworkable with large chambers mounted at floor level. A previous device for lifting the door of a floor-level chamber includes a pivotally mounted hydraulic cylinder for lifting the door above the floor of the room in which the chamber is located. Such a device requires the provision of a complicated hydraulic system which is initially expensive and is costly to maintain and operate. In addition, if the door is to undergo such rotational, vertical and horizontal movements, the door supporting structure must allow such manipulations. Heretofore, no hinge has proven satisfactory to allow the rotational, vertical and horizontal movement of a door of a pressurizable vessel such as a sterilization apparatus.

The subject invention is directed toward a door which overcomes, among others, the above-discussed problems and which is straightforward in design, installation and operation and which is allowed to rotate, be vertically displaced and horizontally displaced relative to a door frame.

SUMMARY OF THE INVENTION

In accordance with the present invention, there is provided a door which may be vertically displaced as well as to rotate and be horizontally displaced relative to a door frame. The particular embodiment disclosed relates to a door for a chamber which is pressurizable, the door being mounted on the end frame of the chamber.

The door may be vertically displaced by means of a motorized slide plate mounted on the door and which cooperates with a lever which acts against the door frame. In particular, a lever is pivotally mounted on the door with the outer end thereof having a roller which engages a block mounted on the door frame. The other end of the lever has a roller that travels in a slot on a slide plate which is supported for vertical movement on the door. A motorized screw causes the slide plate to be raised until the roller on the lever reaches the bottom of the slot at which point the continued upward displacement of the slide plate causes the lever to pivot on the block thereby lifting the door.

The door must, obviously, be free to undergo such movement and its supporting structure includes a plurality of clevises mounted on the outside of the end frame of the chamber. Each clevis includes a lower member having an upper bearing surface and an upper member having an internal chamber which includes a shoulder area. A plurality of slots are provided to extend from the lower portion of the upper member into the internal chamber. A pin is fixed between the upper and lower members of the clevis.

A hinge member is secured to the door for movement therewith. The hinge member includes a main body section and an upper body section extending therefrom. An axial bore is provided through the hinge member of a cross-sectional area in the form of an elongated diameter of the pin. The upper body member of the hinge member is of a diameter less than that of the bore into the internal chamber and is provided with radially extending lugs which may enter the internal chamber of the second body section of the clevis and ride on the shoulder area of the internal chamber.

In the operation of the present invention, when the door and, hence, the hinge, is in its lowermost vertical position, the lower surface of the hinge member may ride on the upper surface of the first section of the clevis with the hinge member being retained on the clevis by means of the pin. However, when the vertical screw is rotated in one direction, the nut is caused to travel thereon and the slide plate is raised until it engages the lever arm which causes the door to be raised. As the door is raised relative to the door frame, the upper body member of the hinge member is caused to enter the internal cavity with the lugs entering the internal cavity by means of the slots. When the door is rotated relative to the end frame, the lugs will ride on the internal shoulder surface thereby supporting the rotation of the door in its upper position.

Accordingly, the present invention provides solutions to the aforementioned problems with previous doors for chambers. As this invention provides an effective door lifting and hinge means for allowing the rotational as well as vertical and horizontal displacement of a door relative to a door frame, the problems of prior art doors are alleviated. The door lifting means provided is straighforward in construction, operation and maintenance and, hence, is less costly overall than previous devices. In addition, as the hinge is capable of providing the above-described degrees of movement for a door, a chamber may be effectively sealed by the door and the door may also be displaced from the end frame of the chamber and rotated to an open position.

These and other details, objects and advantages of the invention will become apparent as the following description of the present preferred embodiment thereof proceeds.

BRIEF DESCRIPTION OF THE DRAWINGS

In the accompanying drawings, I have shown a present preferred embodiment of the invention wherein:

FIG. 8A is a side view of the hinge of the present invention in one position;

FIG. 8B is a side view of the hinge of the present invention in another position;

FIG. 9A is a top view of the invention in one position;

FIG. 9B is a top view of the invention in another position; and

FIG. 9C is a top view of the invention in yet another position.

DETAILED DESCRIPTION OF THE PREFERRED EMBODIMENT

Figure 1:
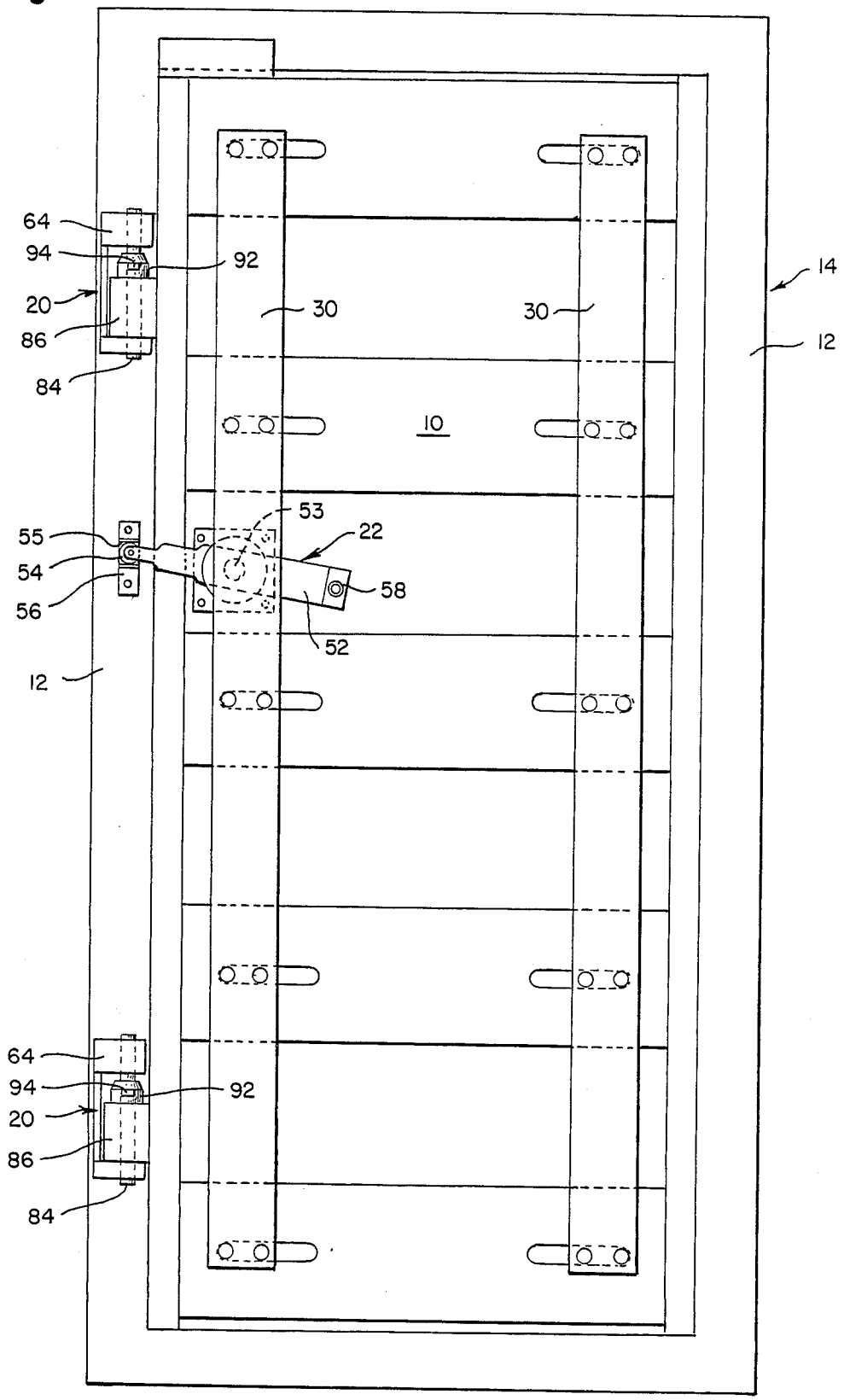
FIG. 1 is a front elevation view of a partially assembled door of a chamber which embodies certain features of the present invention.
Figure 2:
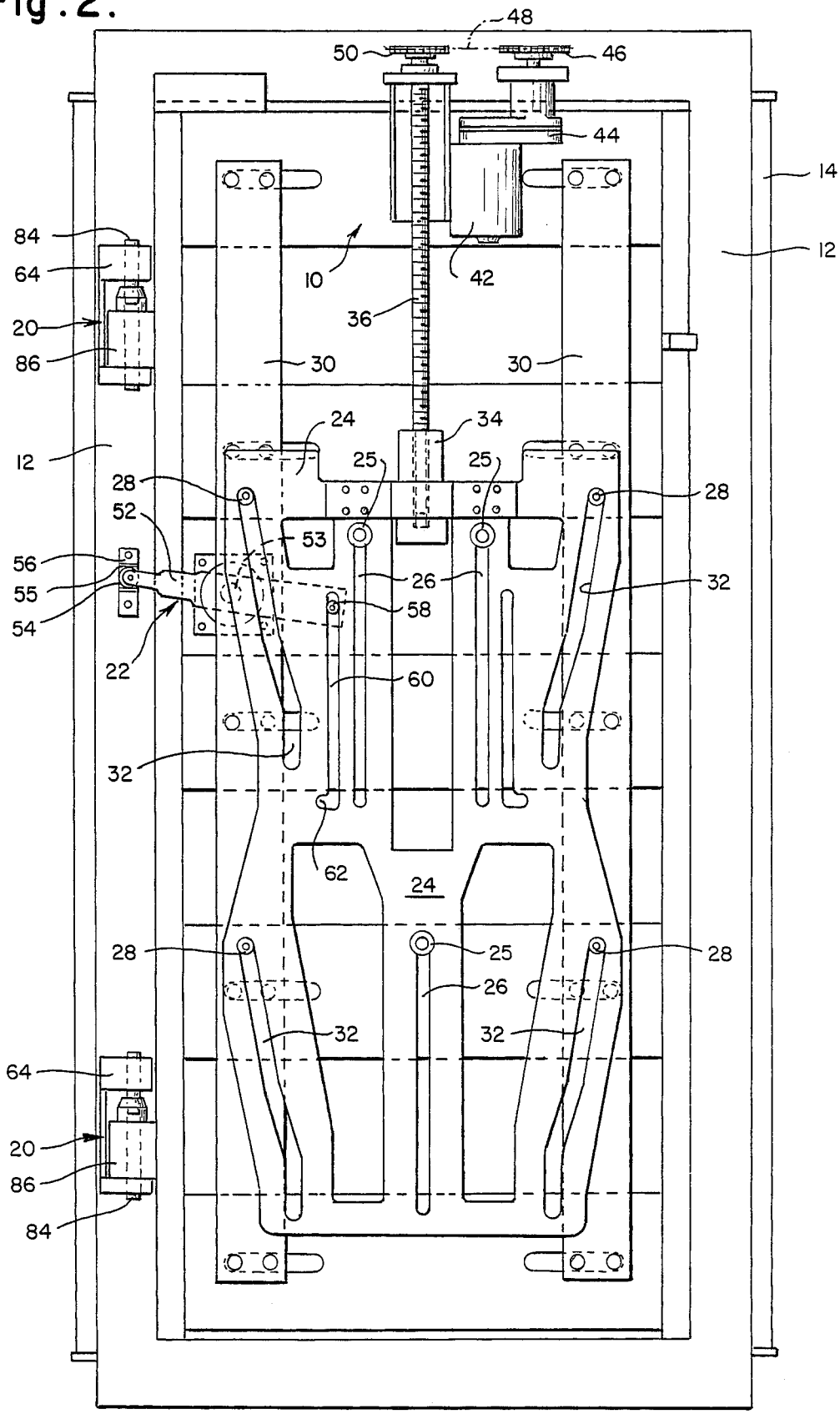
FIG. 2 is a front elevation view of a door of a chamber showing various aspects of the present invention.
Figure 3:
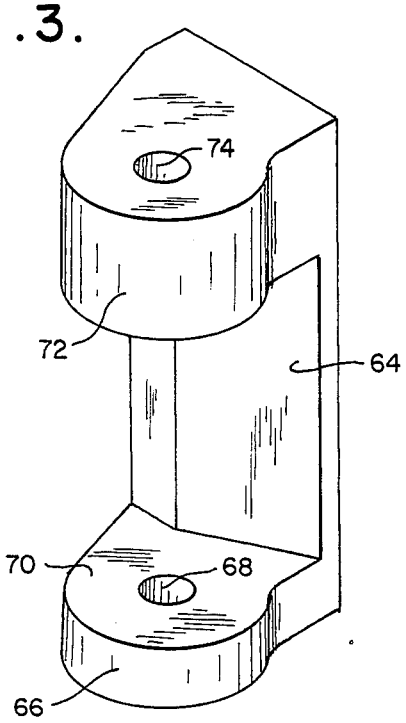
FIG. 3 is an isometric view of the hinge block of the present invention.
Figure 4:
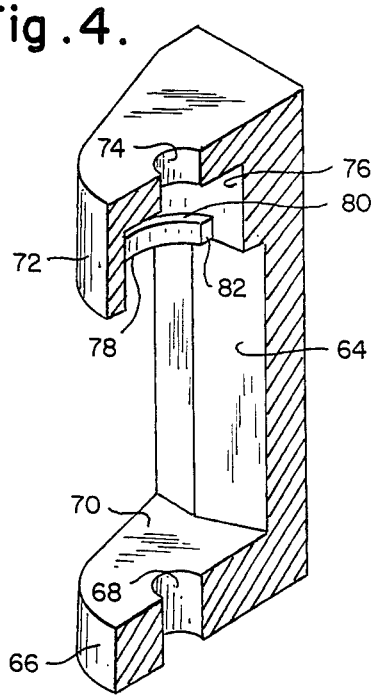
FIG. 4 is a cross-sectional isometric view of the hinge block of the present invention.
Figure 6:
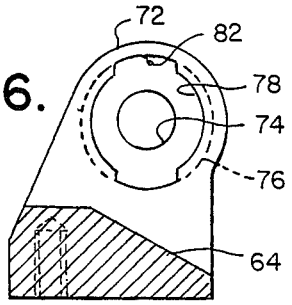
FIG. 6 is a bottom view of the upper portion of the hinge block of the present invention.
Figure 5:
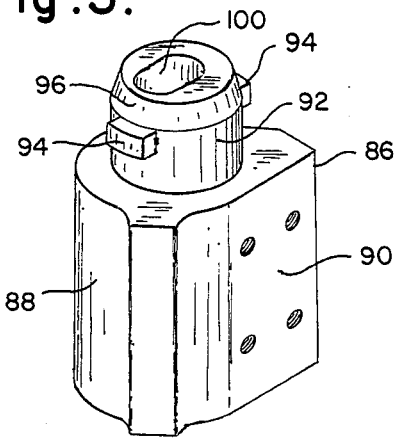
FIG. 5 is an isometric view of the hinge member of the present invention.
Figure 7:
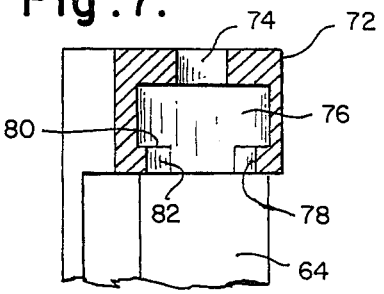
FIG. 7 is a sectional view of the top of the hinge block of the present invention.

Referring now to the drawings wherein the showings are for purposes of illustrating the present preferred embodiment of the invention only and not for purposes of limiting same, the Figures show a door 10 which is supported on the end frame 12 of a vessel 14 having an internal chamber 16. It will be appreciated, however, that door 10 may comprise any door mounted for movement on a door frame.

More particularly, and with reference to FIG. 1, there is shown a plurality of hinges 20 which support a door 10 on an end frame 12. The door 10 may be vertically displaced relative to end frame 12 by means of door lifting means 22. Door lifting means 22 includes a slide plate 24 vertically movably supported on door 10 by means of rollers 25 which are mounted thereon and which cooperate with slots 26 in slide plate 24. Additional rollers 28 serve to support slide plate 24 on longitudinal bars 30 which are horizontally movably mounted on door 10, which rollers 28 act in slots 32 on slide plate 24. As such, slide plate 24 may slide on door 10 and is vertically displaced thereon by the movement of a nut 34 which is attached to slide plate 24 on a vertical screw 36. The nut 34 is caused to travel on screw 36 when screw 36 is rotated by means of a motor 42 which is operatively connected to a transmission 44. The transmission drives a first gear 46 which is connected by means of a chain 48 to a second gear 50 which is connected to screw 36. As such, the rotation of motor 42 causes transmission 44 and, hence, gear 46, to be rotated which by means of chain 48 causes second gear 50 and, hence, screw 36, to be rotated. It will be readily appreciated that the rotation of screw 36 causes traveling nut 34, hence, slide plate 24, to be vertically displaced relative thereto.

The door lifting means 22 also includes a lever bar 52 which is pivotally mounted to the door 10 at a pivot 53. Lever bar 52 is provided at the outer end adjacent end frame 12 with a roller 54 which may ride in a slot 55 on a block 56 mounted on end frame 12. The other end of lever bar 52 is provided with a second roller 58 which is provided to ride in cam slot 60 on slide plate 24. Cam slot 60 is provided with a notched horizontal area 62.

In the operation of the door lifting means 22, the rotation of motor 42 causes the rotation of screw 36 as described hereinabove. When the screw 36 is rotated in a first direction, traveling nut 34 and, hence, door plate 24 are caused to be vertically displaced. Such displacement causes the roller 58 to ride in cam slot 60 until roller 58 enters notched area 62. The continued upward movement of slide plate 24 causes the lever bar 52 to be pivoted relative to first roller 58 which may not be downwardly displaced due to block 56. The pivoting of lever 52 causes door 10 to be lifted relative to end frame 12. To lower door 10, the screw 36 is rotated by motor 42 in the opposite direction which causes slide plate 24 to be lowered. The lowering of slide plate 24 while roller 58 is in engagement with notched area 62 causes the lever 52 to be pivoted in the opposite direction thereby allowing door 10 to be lowered relative to end frame 12. When slide plate 24 has been lowered to a point at which roller 58 of lever arm 52 no longer engages notched area 62, the pressure on lever arm 52 is released and the slot 60 in slide plate 24 travels along roller 58 with no effect on door 10. As such, the door 10 may be vertically raised or lowered by means of the action of door lifting means 22.

It is known that in order for door 10 to seal chamber 16 by means of seal 18 passing around the periphery of door 10, means must also be provided for door 10 to be displaced horizontally toward end frame 12 in order that seal 18 may be compressed the requisite amount. As various means for causing door 10 to be displaced toward end frame 12 are known to those skilled in the art, the particular means by which door 12 is horizontally displaced need not be disclosed herein.

As described above, in order to allow door 10 to provide the desired access to and sealing of end frame 12, the door 10 must be capable of movement between various positions. These positions include an open position in which door 10 is rotated from end frame 12 and access to chamber 16 is permitted, an intermediate position in which door 10 is not in facing relation to end frame 12 and access to the chamber 16 is prohibited, a confronting position in which the door 10 is presented at a lower vertical elevation and in facing relation to end frame 12 and a sealed position in which door 10 is horizontally displaced toward end frame 12 in order that seal 18 may be compressed into sealing engagement with end frame 12. The herein provided hinge 20 is capable of allowing such movements of door 10 relative to end frame 12.

In order to support door 10 on end frame 12, it is preferable that two or more hinges 20 be provided intermediate door 10 and end frame 12. Each hinge 20 includes a clevis 64 which is secured to end frame 12. The clevis 64 includes a first section 66 having an aperture 68 therein and an upper bearing surface 70. The clevis 64 includes a second section 72 which also includes an aperture 74 therethrough. Second section 72 of clevis 64 is provided with an internal cavity which is generally indicated as 76. Internal cavity 76 communicates with the lower portion of second section 72 by means of a bore 78. Internal cavity 76 also includes a shoulder 80 provided therein. Downward extending slots 82 are provided in shoulder 80 for the purposes described below. A pin 84 is provided to be affixed to aperture 74 in second section 72 and aperture 68 in first clevis section 66.

The door 10 is supported on clevis 64 by means of hinge member 86. Hinge member 86 includes a generally cylindrical body 88 which is provided with a flange area 90 by which hinge member 86 is affixed to door 10. Body member 88 of hinge member 86 is provided with a coaxial upper section 92 which is of a lesser diameter than that of body 88 and of bore 78 in second clevis section 72. Upper section 92 is provided with a plurality of radially extending lugs 94 which extend outwardly from upper section 92 to a diameter which is greater than that of bore 78 in second clevis section 72 but less than the internal diameter of cavity 76. In addition, upper section 92 may be provided with a chamfered upper area 96. A bore 100 passes longitudinally through hinge member 86 and is of a cross-sectional area which is that of an elongated diameter of pin 84. When hinge 20 is assembled, the pin 84 will pass through bore 100.

In the operation of hinge means 20, when the door 10 is in its lower position relative to end frame 12, door 10 is supported by means of the engagement of the lower surface of hinge member 86 with bearing surface 70 of first clevis section 76. It will be appreciated that in this position the door 10 may be displaced toward and away from end frame 12 by means of the greater cross-sectional area of bore 100 than that of pin 84. As such, pin 84 will remain fixed while bore 100 is free to move on it. When door 10 is raised relative to end frame 12 by means of lifting means 22 as described above, the upper section 92 of hinge member 96 is caused to enter second section 72 of clevis 64 where the entrance of upper section 92 into bore 78 is guided by means of chamfered area 96 which will first enter bore 78. Lugs 94 will then enter slots 82 of second section 72. When the bottom of lugs 94 have reached an elevation greater than that of shoulder 80, the door 10 may be rotated relative to end frame 12. It will be appreciated that such rotation of door 10 will cause lugs 94 to ride on shoulder 80 thereby supporting door 10 on end frame 12.

Conversely, when it is desired to lower door 10 relative to end frame 12, the lugs 94 must be aligned with slots 82 in second clevis section 72 at which point the door may be lowered until the lower surface of hinge member 86 rests on the bearing surface 70 of first clevis section 66.

It will be understood that various changes in the details, materials and arrangements of parts which have been herein described and illustrated in order to explain the nature of the invention may be made by those skilled in the art within the principle and scope of the invention as expressed in the appended claims.

What is claimed is:

1. A door apparatus for a chamber having a door frame which defines an opening into said chamber, comprising:
   (a) a door of the shape of said opening;
   (b) means mounted on said door for vertically displacing said door relative to said door frame; and
   (c) hinge means mounted on said door frame and attached to said door so as to support said door on said door frame at a first elevation in which said door is not in alignment with said door frame and said door may be horizontally rotatably moved and at a second elevation in which said door is in alignment with said door frame and said door may be horizontally displaced toward and away from said door frame.

2. The door apparatus of claim 1 in which said means for vertically displacing comprises:
   (a) a support means mounted on said door frame;
   (b) a lever bar pivotally mounted on said door, said lever bar including a first end in engagement with said support means and a second end; and
   (c) means mounted on said door for vertically moving said second end relative to said door so that said door is moved vertically relative to said door frame upon the vertical movement of said second end.

3. The door apparatus of claim 2 in which said means for vertically moving said second end comprises:
   (a) a vertical plate mounted on said door for sliding movement relative thereto, said plate having a vertical closed-ended slot therein;
   (b) a first roller mounted on said second end, said first roller being in engagement with said slot; and
   (c) means for vertically driving said plate so that when said first roller engages said closed end the vertical movement of said plate will cause said second end to be vertically moved.

4. The door apparatus of claim 3 in which said means for driving comprises:
   (a) a nut mounted on said plate;
   (b) a screw mounted on said door for rotational movement about its axis, said screw screwedly engaging said nut;
   (c) a motor mounted on said door, said motor having a rotational output; and
   (d) means for transmitting the rotational output of said motor to said screw to rotate said screw so that the rotation of said screw causes said nut to be vertically displaced relative to said screw.

5. The door apparatus of claim 4 in which said means for transmitting comprises:
   (a) a transmission mounted on said door and effective to accept as its input the rotational output of said motor and to provide a secondary rotational output;
   (b) a first gear mounted on said door and effective to be driven by said secondary rotational output;
   (c) a second gear mounted on said door, said second gear being coaxially mounted on said screw; and
   (d) a chain for driving said second gear by said first gear.

6. The door apparatus of claim 2 further comprising a roller mounted on the first end of said lever bar and effective to rollingly engage said support means.

7. The door apparatus of claim 1 in which said hinge means comprises:
   (a) a clevis mounted on said door frame, said clevis comprising:
      (i) an upper body member having an internal cylindrical chamber formed therein, said chamber including an internal supporting surface and a bore extending from said chamber to the bottom of said upper body member, said internal supporting surface having at least one slot formed therein;
      (ii) a lower body member having an upper surface;
   (b) a vertical pin attached between said upper body member and said lower body member; and (c) a hinge member attached to said door, said hinge member having a body having an aperture therethrough, said body including an upper extension having at least one radially extending lug which may vertically pass in said slot, said hinge member being supported by said clevis such that said pin passes through said aperture and when said lug is in vertical alignment with said slot said hinge member is movable between one position in which said door is in its second elevation and the lower surface of said hinge member rides on said upper surface of said lower body and another position in which said door is in its first elevation and said lug may ride on said internal supporting surface when said door is rotated.

8. The door apparatus of claim 7 in which said aperture is of the shape of an elongated cross-section of said pin in a direction normal to said door.

9. The door apparatus of claim 7 in which the upper surface of said upper extension is chamfered.

10. The door apparatus of claim 7 further comprising:

(a) a plurality of clevises mounted on said door frame and a plurality of vertical pins with one vertical pin supported by each clevis; and (b) a plurality of hinge members mounted on said door with each hinge member being in engagement with one of said clevises in said plurality of clevises.

11. A hinge apparatus for supporting a door on a door frame comprising:

(a) a clevis mounted on said door frame, said clevis comprising:

(i) an upper body member having an internal cylindrical chamber formed therein, said chamber including an internal supporting surface and a bore extending from said chamber to the bottom of said upper body member, said internal supporting surface having at least one vertical slot formed therein;

(ii) a lower body member having an upper surface;

(b) a vertical pin attached between said upper body member and said lower body member; and (c) a hinge member attached to said door, said hinge having a body having an aperture therethrough, said body including an upper extension having at least one radially extending lug which may pass in said slot, said hinge member being supported by said clevis such that said pin passes through said aperture and when said lug is aligned with said slot said hinge member is movable between one position in which the lower surface of said hinge member rides on said upper surface of said lower body and another position in which said lug may ride on said internal supporting surface when said door is rotated.

12. The hinge apparatus of claim 11 in which said aperture is of the shape of an elongated cross-section of said pin in a direction normal to said door.

13. The hinge apparatus of claim 11 in which the upper surface of said upper extension is chamfered.

14. The hinge apparatus of claim 11 further comprising:

(a) a plurality of clevises mounted on said door frame and a corresponding plurality of vertical pins;

(b) a plurality of hinge members mounted on said door and in corresponding engagement with said plurality of clevises.

15. Apparatus for vertically displacing a door relative to a door frame on which the door is supported, comprising:

(a) a support means mounted on said door frame;

(b) a lever bar pivotally mounted on said door, said lever bar including a first end in engagement with said support means and a second end;

(c) means mounted on said door for vertically moving said second end relative to said door so that said door is moved vertically relative to said door frame upon the vertical movement of said second end, said means comprising:

(d) a vertical plate mounted on said door for sliding movement relative thereto, said plate having a closed-ended slot therein;

(e) a first roller mounted on said second end, said first roller being in engagement with said slot; and (f) means for vertically driving said plate so that when said first roller engages said closed end the vertical movement of said plate will cause said second end to be vertically moved.

16. Apparatus of claim 15 in which said means for driving comprises:

(a) a nut mounted on said plate;

(b) a screw mounted on said door for rotational movement about its axis, said screw screwedly engaging said nut;

(c) a motor mounted on said door, said motor having a rotational output; and (d) means for transmitting the rotational output of said motor to said screw to rotate said screw so that the rotation of said screw causes said nut to be vertically displaced relative to said screw.

17. Apparatus of claim 16 in which said means for transmitting comprises:

(a) a transmission mounted on said door and effective to accept as its input the rotational output of said motor and to provide a secondary rotational output;

(b) a first gear mounted on said door and effective to be driven by said secondary rotational output;

(c) a second gear mounted on said door, said second gear being coaxially mounted on said screw; and (d) a chain for driving said second gear by said first gear.

18. Apparatus of claim 17 further comprising a second roller mounted on the first end of said lever bar and effective to rollingly engage said support means.

* * * * *